US005522440A

United States Patent [19]

Mitchell

[11] Patent Number: 5,522,440

[45] Date of Patent: Jun. 4, 1996

[54] VAPOR RECOVERY SPOUT GLAND AND VAPOR GUARD MOUNT

[75] Inventor: Thomas O. Mitchell, Maryland Heights, Mo.

[73] Assignee: Husky Corporation, Pacific, Mo.

[21] Appl. No.: 292,842

[22] Filed: Aug. 19, 1994

Related U.S. Application Data

[63] Continuation-in-part of Ser. No. 59,984, May 12, 1993, Pat. No. 5,394,909.

[51] Int. Cl.[6] ..... B67D 5/04

[52] U.S. Cl. ..... 141/392; 141/59; 141/206

[58] Field of Search ..... 141/59, 206, 290, 141/392, 302

[56] References Cited

U.S. PATENT DOCUMENTS

| | | | |
|---|---|---|---|
| 3,811,486 | 5/1974 | Wood | 141/208 |
| 3,929,175 | 12/1975 | Coone | 141/392 |
| 4,125,139 | 11/1978 | Guertin et al. | 141/206 |
| 4,204,563 | 5/1980 | Ryle | 141/206 |
| 4,343,337 | 8/1982 | Healy | 141/302 X |
| 4,429,725 | 2/1984 | Walker et al. | 141/59 |
| 4,497,350 | 2/1985 | Guertin | 141/206 |
| 5,213,142 | 5/1993 | Koch et al. | 141/59 |
| 5,327,945 | 7/1994 | Simpson et al. . | |

*Primary Examiner*—J. Casimer Jacyna
*Attorney, Agent, or Firm*—Paul M. Denk

[57] ABSTRACT

A spout gland is provided for a vapor recovery fuel dispensing nozzle assembly having a nozzle body and a nozzle spout assembly. The nozzle body includes a body fuel flow path having an inlet and an outlet and a body vapor recovery path, and a venturi valve in the body fuel flow path. The spout assembly is connected to the body and defines a spout fuel flow path and a spout vapor recovery path in communication with the respective flow paths in the nozzle body. The spout assembly includes a spout tube defining the spout fuel flow path, the spout gland, and a vapor guard. The spout gland has a diameter, in part, that is larger than the diameter of said spout tube to define a generally forwardly opening annular channel around the spout tube. The gland has at least one opening in a wall thereof to place the channel in communication with an area external of said spout gland and the body vapor flow path. The vapor guard is secured to the spout gland so that the channel defined by the vapor guard and the spout tube is in communication with the channel defined by the spout gland and the spout tube, to define the spout assembly's vapor recovery flow path. The spout gland thus both secures the vapor guard to the spout tube, and places the spout assembly vapor recovery flow path in communication with the body vapor recovery flow path.

9 Claims, 2 Drawing Sheets

VAPOR RECOVERY SPOUT GLAND AND VAPOR GUARD MOUNT

CROSS-REFERENCE TO RELATED APPLICATION

This application is a continuation-in-part of U.S. patent application having Ser. No. 08/059,984, filed on May 12, 1993, now U.S. Pat. No. 5,394,909, all being owned by a common assignee.

BACKGROUND OF THE APPLICATION

This application relates to fuel dispensing nozzles, and, in particular, to a vapor recovery spout gland which is used to secure a vapor guard to the spout.

Bellows or vapor guards are often provided around a gas nozzle's spout to facilitate the retention of gas or fuel vapors in an enclosed area to reduce the amount of vapor that enters the atmosphere. Generally, the vapor guard is secured to the body of the nozzle. Thus, when the nozzle is assembled, the bellows must be passed over the spout once it has been secured to the nozzle body. Alternatively, the spout must be secured to the body once the bellows has been put in place. In either event, the construction of the nozzle is more complicated than necessary because the spout and bellows can not be secured to the nozzle body as a unit.

Many fuel dispensing nozzles are presently provided with a venturi which may be used for a variety of purposes, including vapor recovery and automatic shutoff, amongst other features. Automatic shutoff systems typically depend upon a vent tube, in communication with the venturi, which extends nearly the length of the nozzle's spout. Because the tube is used to regulate the automatic shutoff, and assist in vapor recovery, the tube cannot be used for other functons, such as recognizing when a tank requires specialty fuels or whether the vehicle has an on-board recovery system, for example. It would be beneficial to use other means, for example, to provide the vapor recovery flow path, so that the vent tube can be used for other purposes.

SUMMARY OF THE INVENTION

One object of the invention is to provide a vapor recovery spout gland for a fuel dispensing nozzle.

Another object is to provide such a spout gland to which a vapor guard may be secured.

Another object is to provide such a spout gland which, in combination with the vapor guard, will provide a path externally of the nozzle spout, for fuel vapor to follow in a vapor recovery nozzle.

These and other objects will become apparent to those skilled in the art in light of the following disclosure and accompanying drawings.

In accordance with the invention, generally stated, a nozzle assembly for dispensing fuel from a source to a container is provided. Preferably, the nozzle is a vapor recovery nozzle and includes both a fuel flow path and a vapor recovery flow path. The nozzle assembly includes a nozzle body defining a body fuel flow path having an inlet and an outlet and a body vapor recovery path. The body includes a venturi valve in the body fuel flow path which has a valve body, a valve seat, and a valve member. The valve member is movable between a first position in which it seats against the valve seat to close the venturi valve and a second position in which the venturi valve is opened. The valve member being biased to normally close the venturi valve. As is known, the valve is opened by pressure from fuel flowing through the fuel flow path and closes when fuel flow through the fuel flow path stops.

A spout assembly is connected to the body and defines a spout fuel flow path therein, in fluid communication with the nozzle body fuel flow path, and a spout vapor recovery path, in fluid communication with the nozzle body vapor recovery path. The spout assembly has a spout tube defining the spout fuel flow path, a spout gland secured to the spout tube at a first end thereof, and a vapor guard or vapor collector secured to the spout gland. A venturi tube may extend along the inside of the of spout tube. The spout gland has a diameter, in part, that is larger than the diameter of the spout tube so that the spout tube and the spout gland define a generally annular channel. The spout gland has at least one opening in its wall to place the channel in communication with an area external of the spout gland. The spout gland is received in the nozzle outlet to connect the spout assembly to the nozzle body. The spout gland opening is in communication with the body vapor flow path, to place the annular channel in communication with the nozzle body vapor flow path.

A vapor guard is secured to the spout gland. The vapor guard has an inner diameter greater than the spout tube to define a second channel surrounding the spout tube which is in communication with, and generally an extension of the first channel. The first and second channels define the spout assembly's vapor flow path.

A check or vapor valve is positioned in the nozzle body vapor recovery flow path. It is movable between a first position in which the vapor recovery flow path is closed and a second position in which the vapor recovery flow path is opened. Preferably, the vapor valve is normally biased to the first, closed position. The vapor valve is operatively associated with the automatic shut-off mechanism of the fuel dispensing nozzle. The valve includes a control section having a control port which is in communication With the fuel flow path. The vapor valve is operable, when the hand lever of the nozzle is opened, to move the vapor valve between the closed and opened positions. It is located around the automatic shut-off mechanism of the nozzle.

The spout gland includes a rear section, a central section, and a forward section. The central section has slightly greater diameter than the spout tube so that the gland may be secured to the spout tube. Because the spout gland is secured to the spout tube along the gland's central section, the central section defines a rear end of the spout assembly channel. Preferably, the spout gland is internally threaded at the central section, to screw the spout gland onto the spout tube. The nozzle body outlet includes a body having a nose sized to receive the spout gland. The nose defines a passageway which is in communication with the diaphragm valve and which defines at least a part of the body vapor flow path. The nozzle outlet nose and the gland are sized and shaped to place the gland opening in communication with the nose passageway to place the body vapor flow path in communication with the spout assembly vapor flow path.

Preferably, the spout gland includes an external radially extending flange forwardly of the opening. The flange has a rear surface abutting a forward surface of the nozzle body outlet nose. A lock ring fits over the gland flange and the body outlet nose to secure the spout assembly to the nozzle body. The spout gland also includes an external circumferential groove formed forwardly of the flange. The vapor guard includes a generally cylindrical rear section and a flexible bellows section. The rear section is slidably received over the forward part of the spout gland and includes an internal generally circumferential lip which is received in the spout gland groove. A clamp surrounds the vapor guard cylindical section to secure the vapor guard to the spout gland.

DESCRIPTION OF THE PREFERRED EMBODIMENT

Figure 1:
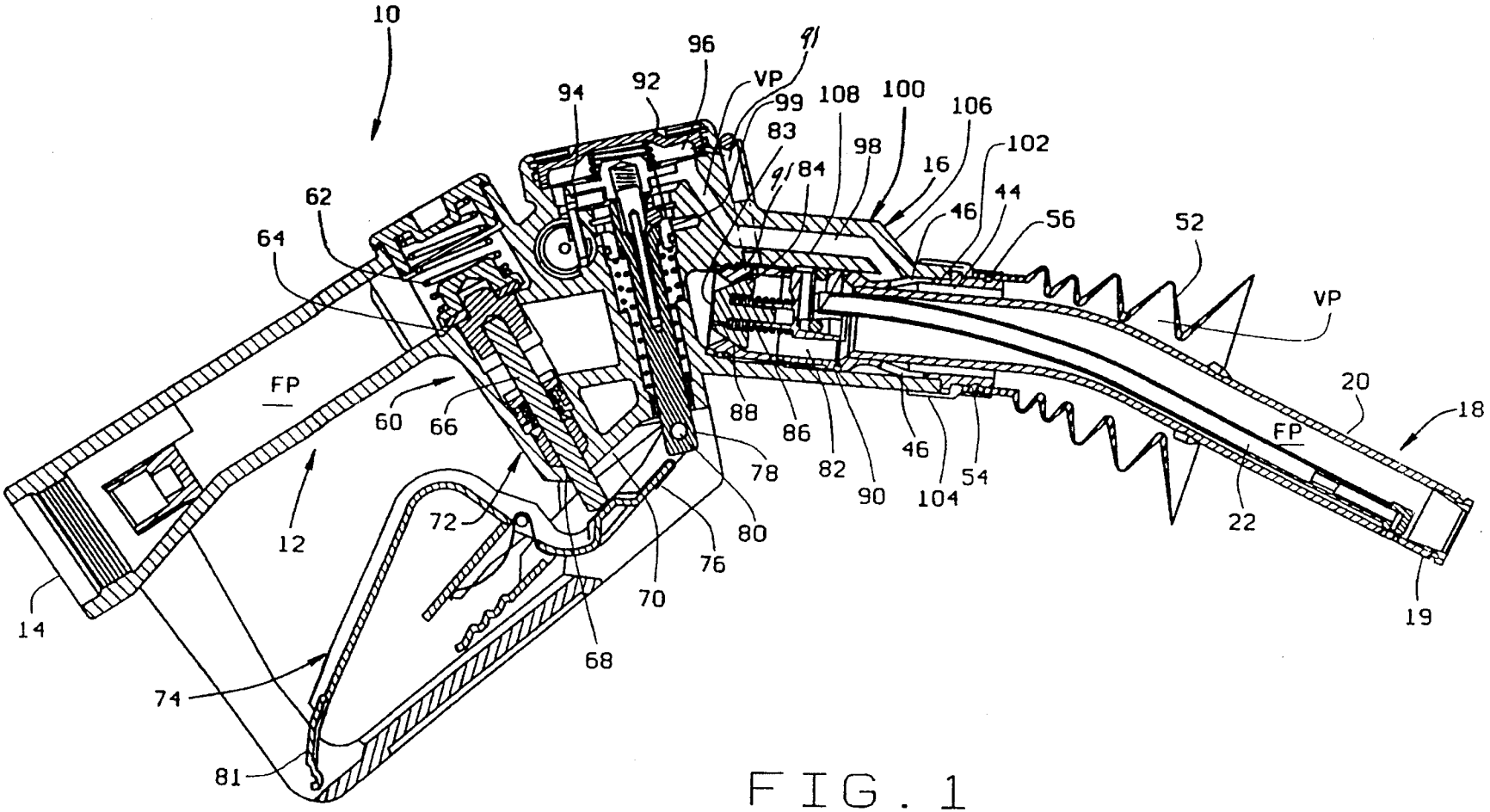
FIG. 1 is a cross-sectional view of a fuel dispensing nozzle incorporating a spout gland of the present invention.

An illustrative embodiment of a fuel dispensing nozzle 10 is shown in FIG. 1. The nozzle is preferably a vapor recovery nozzle, such as a vacuum assist vapor recovery nozzle, as for example. The nozzle includes a body 12 having an inlet 14 to which a fuel hose (not shown) is connected. The nozzle also has an outlet 16 communicating with a spout assembly 18. The body inlet and outlet, and the spout define a fuel flow path FP through which fuel flows from a storage tank to the vehicle's fuel tank.

Figure 4:
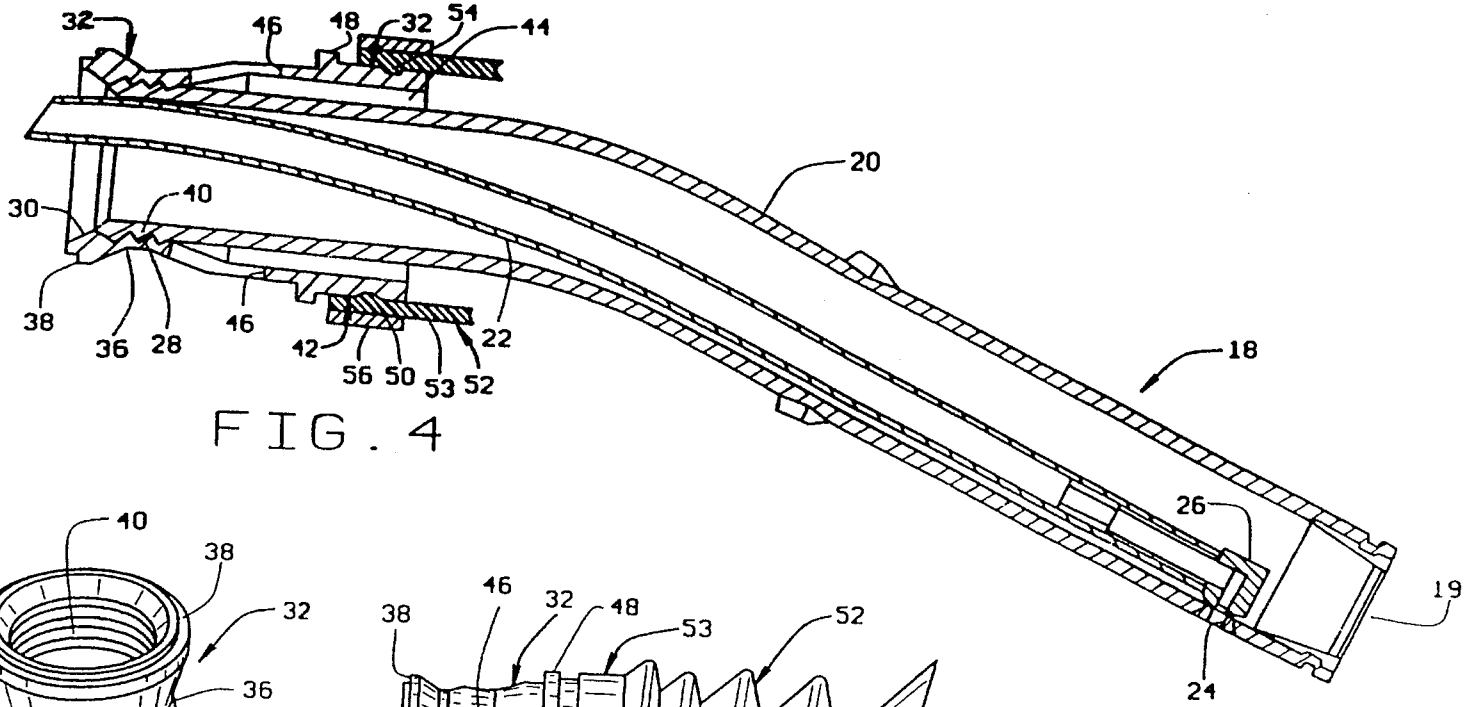
FIG. 4 is a side elevational view of the nozzle spout with the spout gland secured thereto.
Figure 3:
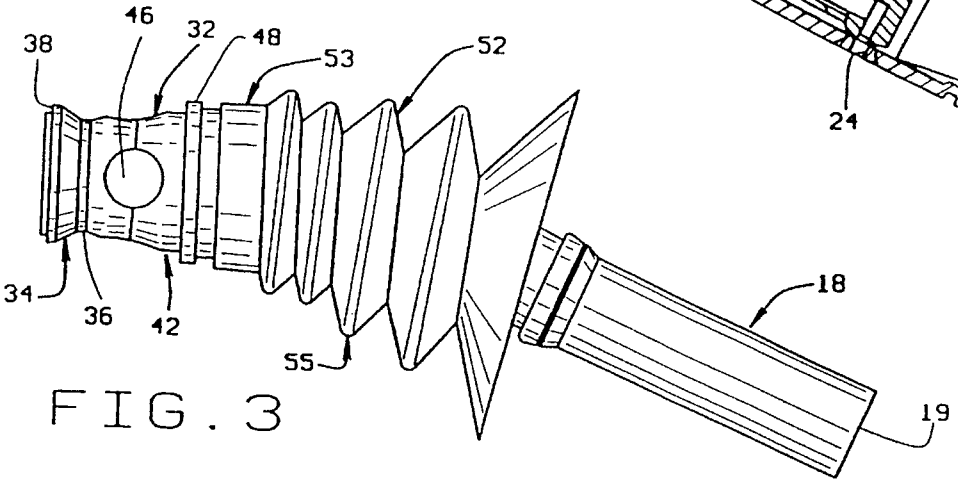
FIG. 3 is a side elevational view of a nozzle spout assembly.
Figure 2:
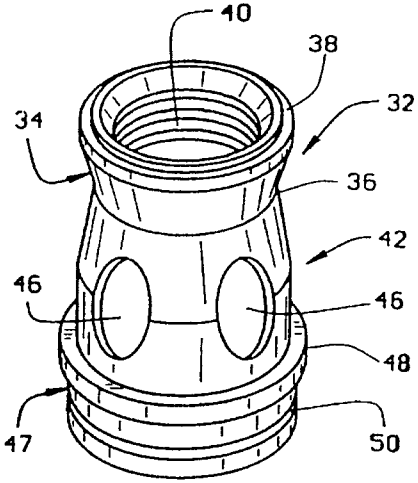
FIG. 2 is a perspective view of the spout gland.

As seen in FIGS. 3 and 4, spout assembly 18 includes a tube 20 having a mouth 19 which is insertable into the fill pipe of an automobile fuel tank. A vent tube 22 extends through tube 20 and is secured to an inner surface of the tube near mouth 19. Tube 20 has a vent opening 24 in its wall, to place the end of the vent tube in communication with the atmosphere through the wall of tube 20. Vent tube 22 is secured in tube 20 by a tip 26 to place the end of tube 22 in communication with opening 24, and hence, in communication with the atmosphere. Tube 20 is threaded, as at 28, at an end 30 of tube 20 remote from mouth 19.

A spout gland 32 is threadably secured to tube 20 proximate tube end 30. Gland 32 has a back section 34 which is generally conical in shape and widens rearwardly from a waist 36. Section 34 defines a shoulder 38 at its back surface which facilitates connection of the spout assembly 18 to the body exit 16, as is described below. Gland 32 is internally threaded, as at 40, generally about the waist region 36 of the gland. Threads 40, as can be appreciated, are used to screw the gland onto the spout tube 20. Forwardly of waist 36, gland 32 widens, as can be seen in FIG. 4, to define a forward section 42 of the gland. The forward section 42 widens so that its inner surface and the outer surface of tube 20 cooperate to define a generally annular space 44. Annular space 44 extends from the threads 28 to the end of the gland, as can be seen in FIG. 4. Openings 46 are formed in gland 32 in the forward section, just forward of waist 36 to place space 44 in communication with the atmosphere through the gland. Gland 32 levels out forwardly of openings 46 to define a generally cylindrical front section 47. A circumferential flange 48 extends radially from gland 32 forwardly of openings 46 in front section 47 and an annular groove 50 is formed in gland 32 forwardly of flange 48.

Gland 32 operates, in part, to secure a vapor guard 52 to spout assembly 18. Vapor guard 52 has a generally cylindrical section 53 sized to fit about the forward end 47 of gland 32 and a bellows section 55 which extends forwardly from section 53 over spout tube 20. Vapor guard 52 includes an internal, circumferential lip 54 formed in section 53 which is received in gland groove 50. A circular clamp 56, such as a hose clamp, is used to secure the guard to the gland. Guard 52 extends forwardly from the gland, about spout tube 20, as seen in FIGS. 1 and 3, to contact the side of the vehicle, as is known. The interior of gland 52 is in fluid communication with, and forms a continuation of, space 44.

The construction nozzle body 12 is shown in detail in FIG. 1. A poppet valve 60 is placed within body 12 between its inlet 14 and outlet 16. Valve 60 is biased by a spring 62 into sealing engagement with a poppet valve seat 64. Poppet 60 is secured to the upper end of a valve stem 66. Poppet valve 60 is located in the upper portion of body 12, and the valve stem 66 extends downwardly through the body. The lower end of the stem projects through an opening 68 in the base 70 of a body section 72. An operating lever 74 for the nozzle has one end 76, its pivoting functional end, connected to the lower end of the automatic shut-off plunger 78 by, for example, a pin 80. The other end 81 of the lever is grasped by the hand of a user, and when squeezed, the upward pressure on the lever forces the valve stem 66 upwardly. This moves valve 60 off valve seat 64, opening the valve, and permitting fuel flow through the nozzle.

A variable venturi 82 is positioned in flow path FP adjacent nozzle outlet 16. A spring loaded check valve 83 is positioned in the venturi, on the downstream side thereof, to control fuel flow into the outlet, and to the spout. The check valve has a valve member 84 which is frustoconically shaped and fits into the flow restriction formed by the venturi. Valve member 84 is biased closed by a spring 86 to seat against a valve seat 88. When poppet valve 60 is opened, the rush of fuel through the nozzle body unseats the check valve 83 so fuel can flow through the venturi 82 to the nozzle spout and outlet. The flow rate is a function of the extend to which valve 83 is pushed downstream against the force of spring 86.

Venturi 82 is installed in a circular housing 90 which is received in outlet 16. When the vehicle's tank is substantially full, it is desirable to terminate flow of fuel through the nozzle so as to not over fill the tank. An automatic shutoff assembly 92 is thus provided. Shutoff assembly 92 is explained in detail in U.S. Pat. No. 5,197,523, which is incorporated herein by reference. The shutoff assembly 92 is controlled, in part, by a diaphragm assembly 94. A chamber 96 is defined above diaphragm assembly 94 which is connected to the venturi by an air passage 91. When fuel flows over the venturi 82, a partial vacuum is created that is communicated to chamber 96 via passage 91.

Nozzle outlet 16 includes an outlet body 100 having a forward nose portion 102. Nose portion 102 is sized to receive the back end 34 of gland 32. Preferably, the diameter of nose 102 is slightly wider than the diameter of the gland front section 47 behind gland flange 48. The flange 48 thus abuts the edge of noze 102. A retaining ring or lock ring 104 is positioned between the flange 48 and the back edge of vapor guard 52. Ring 104 extends over flange 48 and a part of nose 102 to secure spout assembly 18 to nozzle body 12. At the top of the outlet body 100, as seen in FIG. 1, a sloped wall 106 is provided. An interior wall 108 extends from a back portion of outlet body 100 towards wall 106, but ends short of wall 106. Wall 108 and sloped wall 106 define the air passage 98, as seen in FIG. 1.

The gland 32 is sized so that the openings 46 are in communication with the passage 98. Passage 98 is thus in communication with annular space 44 surrounding spout tube 20. Space 44 and passage 98 therefore cooperate to define a vapor return flow path VP which operates to pass vapors past the vapor check valve 99 that functions in conjunction with the set-up of the automatic shut-off mechanism 92, when the nozzle is turned on, to return fuel vapors to the fuel storage tank. By placing the vapor recovery flow path VP in the vapor guard 52 and spout gland 32, it conveniently passes the returning vapors directly to and through the nozzle.

As can be appreciated, a fuel dispensing nozzle having a vacuum assist vapor recovery system has been provided with a spout gland which places the vapor recovery flow path in communication with the space between the vapor guard and the spout tube, freeing up the spout and its internal vent tube for other purposes. The spout gland is also designed so that it may be used to secure the vapor guard to the nozzle, at a convenient position more rearwardly of the spout. This eases the assembly of nozzle 10, by permitting the vapor guard and spout to be secured to the nozzle body as a unit.

The foregoing description is set forth for illustrative purposes only. It is not intended to be limiting. Variations within the scope of the appended claims may be apparent to those skilled in the art. For example, although the exterior of the spout gland has a varying outer diameter, the spout gland could have a constant outer diameter, as long as the openings 46 are in communication with the passageway 98. The spout gland 32 could be secured to the spout tube 20 by means other than the threads. For example, it could be press fit about the tube, or it could be welded to the tube. These examples are merely illustrative.

Having thus described the invention, what is claimed and desired to be secured by Letters Patent is:

1. In a nozzle assembly for dispensing fuel from a source to a container, the nozzle assembly comprising:

a nozzle body defining a body fuel flow path having an inlet and an outlet and a body vapor recovery path, the body including a venturi valve in said body fuel flow path; said venturi valve having a valve body, a valve seat, and a valve member, said valve member being movable between a first position in which it seats against said valve seat to close said venturi valve and a second position in which said venturi valve is opened, said valve member being biased to normally close said venturi valve, said venturi valve being opened by pressure from fuel flowing through said fuel flow path, said venturi valve being closed when fuel flow through said fuel flow path stops;

a spout assembly connected to said body and defining a spout fuel flow path and a spout vapor recovery path, said spout fuel flow path being in fluid communication with said body fuel flow path and said spout vapor recovery path being in fluid communication with said body vapor recovery path; said spout assembly including:

a spout tube defining said spout fuel flow path;

a spout gland secured to said spout tube at a first end thereof, said spout gland having a diameter, in part, that is larger than the diameter of said spout tube, said spout tube and said spout gland defining a generally annular channel, said spout gland having at least one opening in a wall thereof to place said channel in communication with an area external of said spout gland, said spout gland being received in said nozzle outlet to connect said spout assembly to said nozzle body, said spout gland opening being in communication with said body vapor flow path; and a vapor guard secured to said spout gland, said vapor guard having an inner diameter greater than said spout tube to define a second channel surrounding said spout tube, said second channel being in communicaton with said first channel, said first and second channels defining said spout assembly vapor flow path;

said spout gland includes a rear section, a central section, and a forward section; said central section being slightly greater than said spout tube so that said gland may be secured to said spout tube, said central section defining a rear end of said spout assembly channel;

said nozzle body outlet includes a body having a nose sized to receive said spout gland, said nose defining a passageway in communication with said vapor recovery flow path, said passageway defining at least a part of said body vapor flow path, said nozzle outlet nose and said gland being sized and shaped to place said gland opening in communication with said nose passageway to place said body vapor flow path in communication with said spout assembly vapor flow path;

said spout gland includes an external radially extending flange forwardly of said opening; said flange having a rear surface abutting a forward surface of said nozzle body outlet nose;

a lock ring which fits over said gland flange and said body outlet nose to secure said spout assembly to said nozzle body, said spout gland including an external circumferential groove formed forwardly of said flange, said vapor guard including a generally cylindrical rear section and a flexible bellows section; said rear section including an internal generally circumferential lip which is received in said spout gland groove.

2. The nozzle assembly 1 including a clamp surrounding said vapor guard cylindrical section to secure said vapor guard to said spout gland.

3. A spout assembly for a fuel dispensing nozzle, the spout assembly including a spout tube defining a fuel flow path through said spout assembly which delivers fuel from said dispensing nozzle to a vehicle, said spout gland secured to said spout tube, and a vapor guard secured to said spout gland; said spout gland and said vapor guard cooperating with said spout tube to define a channel surrounding said spout tube, said channel defining a vapor flow path for returning fuel vapors to said nozzle, said spout gland is operatively connected to said tube near an end of said tube, said spout gland defining a first diameter which is slightly larger than said spout tube diameter to connect said spout gland to said spout tube and a second diameter, larger than said first diameter and the diameter of said spout tube to define a part of said channel, said spout gland is internally threaded along at least a portion of said first diameter, said spout tube being threaded approximate an end thereof, said spout gland being threadily securable to said spout tube, said vapor guard includes a generally cylindrical section and a flexible bellows section, said generally cylindrical section being sized to be received about a forward end of said spout gland, said spout assembly including a clamp to secure said vapor guard cylindrical section to said spout gland, said spout gland includes an external groove extending around at least a part of said spout gland, said vapor guard cylindrical section having an integral lip receivable in said spout gland groove, and a lock ring sized to secure said spout assembly to said nozzle.

4. The spout assembly of claim 3 wherein said spout gland includes a radially extending flange forward of said gland opening, said lock ring being received about said spout gland forward of said flange and including a cylindrical section which extends rearwardly over said flange.

5. The spout assembly of claim 4 wherein said lock ring is positioned between said flange and said vapor guard.

6. In a nozzle assembly for dispensing fuel from a source to a container, the nozzle assembly comprising:

a nozzle body defining a body fuel flow path having an inlet and an outlet and a body vapor recovery path, the body including a venturi valve in said body fuel flow path; said venturi valve having a valve body, a valve seat, and a valve member, said valve member being movable between a first position in which it seats against said valve seat to close said venturi valve and a second position in which said venturi valve is opened, said valve member being biased to normally close said venturi valve, said venturi valve being opened by pressure from fuel flowing through said fuel flow path, said venturi valve being closed when fuel flow through said fuel flow path stops;

a spout assembly connected to said body and defining a spout fuel flow path and a spout vapor recovery path, said spout fuel flow path being in fluid communication with said body fuel flow path and said spout vapor recovery path being in fluid communication with said body vapor recovery path; said spout assembly including:

a spout tube defining said spout fuel flow path;

a spout gland secured to said spout tube at a first end thereof, said spout gland having a diameter, in part, that is larger than the diameter of said spout tube, said spout tube and said spout gland defining a generally annular channel, said spout gland having at least one opening in a wall thereof to place said channel in communication with an area external of said spout gland, said spout gland being received in said nozzle outlet to connect said spout assembly to said nozzle body, said spout gland opening being in communication with said body vapor flow path; and a vapor guard secured to said spout gland, said vapor guard having an inner diameter greater than said spout tube to define a second channel surrounding said spout tube, said second channel being in communication with said first channel, said first and second channels defining said spout assembly vapor flow path;

an automatic shut-off mechanism provided in said nozzle body and in communication with said vapor recovery flow path, said mechanism being movable between a first position in which said vapor recovery flow path is closed and a second position in which said vapor recovery flow path is opened, said mechanism being normally biased in said first, closed position;

a vent tube extending through said spout tube, said vent tube being in communication with said venturi at one end thereof, said spout including a vent opening in a wall near a second end of said spout tube, said vent tube being in communication with said vent opening at a second end thereof;

said spout gland includes a rear section, a central section, and a forward section; said central section being slightly greater than said spout tube so that said gland may be secured to said spout tube, said central section defining a rear end of said spout assembly channel; said nozzle body outlet includes a body having a nose size to receive said spout gland, said nose defining a passageway in communication with said vapor recovery flow path, said passageway defining at least a part of said body vapor flow path, said nozzle outlet nose and said gland being sized and shaped to place said gland opening in communication with said nose passageway to place said body vapor flow path in communication with said spout assembly vapor flow path, a rear edge of said spout gland abutting said venturi valve body, said spout includes an external radially extending flange forwardly of said opening; said flange having a rear surface abutting a forward surface of said nozzle body outlet nose; and;

said spout gland being located totally within the front of the nozzle body outlet and the rearward portion of the said vapor guard.

7. The nozzle assembly of claim 6 including a lock ring which fits over said gland flange and said body outlet nose to secure said spout assembly to said nozzle body.

8. A spout assembly for a fuel dispensing nozzle, the spout assembly including a spout tube defining a fuel flow path through said spout assembly which delivers fuel from said dispensing nozzle to a vehicle, a spout gland secured to said spout tube, and a vapor guard secured to said spout gland; said spout gland and said vapor guard cooperating with said spout tube to define a channel surrounding said spout tube, said channel defining a vapor flow path for returning fuel vapors to said nozzle, said spout gland is operatively connected to said tube near an end of said tube, said spout gland defining a first diameter which is slightly larger than said spout tube diameter to connect said spout gland to said spout tube and a second diamter, larger than said first diameter and the diameter of said spout tube to define a part of said channel; said spout gland has at least one opening in a wall to place said channel in communication with an atmosphere external of said spout gland, said spout gland is internally threaded along at least a portion of said first diameter, said spout tube being threaded proximate an end thereof, said spout gland being threadibly securable to said spout tube, said vapor guard includes a generally cylindrical section and a flexible bellows section, said generally cylindrical section being sized to be received about a forward end of said spout gland, said spout assembly including a clamp to secure said vapor guard cylindrical section to said spout gland, and said nozzle defining a body and having an outlet at its forward end thereof, and said spout gland being contained totally within said nozzle outlet and the cylindrical section of the flexible bellows.

9. The spout assembly of claim 8 wherein said spout gland includes an external groove extending around at least a part of said spout gland, said vapor guard cylindrical section having an internal lip receivable in said spout gland groove.

* * * * *